US009031425B2

(12) United States Patent
Mendoza

(10) Patent No.: US 9,031,425 B2
(45) Date of Patent: May 12, 2015

(54) CUSTOMER REPLACEABLE UNIT MONITOR POSITIONING APPARATUS

(71) Applicant: Xerox Corporation, Norwalk, CT (US)

(72) Inventor: Ricardo H. Mendoza, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 53 days.

(21) Appl. No.: 13/832,697

(22) Filed: Mar. 15, 2013

(65) Prior Publication Data

US 2014/0270816 A1 Sep. 18, 2014

(51) Int. Cl.
*G03G 15/08* (2006.01)
*G03G 21/18* (2006.01)

(52) U.S. Cl.
CPC ..... *G03G 21/1842* (2013.01); *G03G 15/0863* (2013.01)

(58) Field of Classification Search
CPC ..... C02F 5/105; F02B 2075/027
USPC ..... 399/27, 109, 110, 108
See application file for complete search history.

(56) References Cited

U.S. PATENT DOCUMENTS

2007/0047974 A1* 3/2007 Tanaka ..... 399/8
2010/0189470 A1* 7/2010 Yoshizawa et al. ..... 399/262

* cited by examiner

*Primary Examiner* — Roy Y Yi
(74) *Attorney, Agent, or Firm* — Ronald E. Prass, Jr.; Prass LLP

(57) ABSTRACT

A cartridge plug for a CRUM-enabled ink or toner cartridge includes a CRUM device seated in an annular position, secured in a recess at a center of the cap. The recess is formed in a mounting surface of the cap that extends above a peripheral surface of the cap that the surrounds the mounting surface. The mounting surface is contiguous with the peripheral surface, being interposed by flexible walls that compress under load. The mounting surface is compressible under load by way of the flexible walls, and springs back to a resting position as a load is decreased.

11 Claims, 1 Drawing Sheet

CUSTOMER REPLACEABLE UNIT MONITOR POSITIONING APPARATUS

FIELD OF DISCLOSURE

The disclosure relates to custom replaceable unit monitor ("CRUM") apparatus. In particular, the disclosure relates to CRUM positioning apparatus for positioning a CRUM with respect to a detector or CRUM reader.

BACKGROUND

Related art CRUM systems are configured for determining a status or state of consumable subsystems to enhance system productivity and efficiency using a CRUM device and a CRUM reader, sensor, or detector for acquiring data from the CRUM device. A CRUM device is a programmed chip device that is readable by a CRUM reader, a device with a receiver that is configured for receiving data transmitted by the CRUM device. For example, a toner supply system may be configured for CRUM monitoring to enable monitoring of a xerographic system to determine toner levels. The CRUM may be a device that is configured to obtain and communicate system data such as toner levels. Such system data may enable, for example, determining how many prints may be made using a system having the CRUM-enabled toner supply system.

Some CRUM-enabled systems such as ink or toner cartridge systems may include a CRUM device disposed on an outer surface of the cartridge, e.g., a radial surface. Some related art CRUM-enabled cartridge systems include a CRUM device disposed at a central axis of rotation of the cartridge to enable 360° C. access to the CRUM by a CRUM reader.

SUMMARY

It has been found that radial placement of the CRUM device on the cartridge may be disadvantageous insofar as this placement allows for CRUM readers to read CRUM devices only once per revolution of the cartridge. It has been found that related CRUM systems wherein in a CRUM device is disposed at a central axis may be disadvantageous insofar as tolerance stack up may cause the CRUM device and the CRUM reader to define a reading gap that is too wide for operable reading of CRUM data from the device by the reader. Different CRUM readers may have different tolerances to stack up. Improved CRUM apparatus for CRUM-enabled systems having a cartridge are provided.

An embodiment of apparatus may include a CRUM device positioning apparatus for aligning a CRUM device for reading by a CRUM reader having a cap configured for covering or plugging a container, the cap including a peripheral surface; and a mounting surface, the mounting surface being surrounded by the peripheral surface, and when in a resting position, extending above the peripheral surface and away from a cavity defined by the container being covered when the cap is engaged to the container.

In an embodiment, apparatus may include flexible walls, the flexible walls connecting the mounting surface and the peripheral surface, the flexible walls being compressible under load whereby the mounting surface is depressible from the resting position to a load-bearing position wherein a spring force urges the mounting surface towards the resting position. Apparatus may include a recess disposed in the mounting surface, the recess being formed to cause a CRUM device to be centrally aligned for central axial alignment along a rotational axis of the container when the cap is engaged to the container.

In an embodiment, apparatus may include a plurality of detents formed in the mounting surface forming securing the CRUM device in the recess. A CRUM device may be disposed on the mounting surface. Detents may be configured in the recess for securing a CRUM device, which may be disposed in the recess. A CRUM reader may be disposed to read data from a CRUM device when the container is in an engaged position. For example, the CRUM reader may be configured to be positioned for reading a CRUM when a door to which the reader is attached is closed on the a CRUM-device enabled cartridge.

In an embodiment, the recess may have a depth that is 0.2 mm deeper than a thickness of the CRUM device. The container may be a toner cartridge. A wear-resistant material may be disposed on the mounting surface for contacting a CRUM reader. Alternatively, or in addition, a wear-resistant material disposed on the CRUM device for contacting the CRUM reader. The recess may be configured to cause the CRUM device to be placed at a position on an axial center line or central rotational axis of the cap and the container whereby the CRUM device is configured for alignment with a CRUM reader.

Exemplary embodiments are described herein. It is envisioned, however, that any system that incorporates features of systems described herein are encompassed by the scope and spirit of the exemplary embodiments.

DETAILED DESCRIPTION

Figure 1:
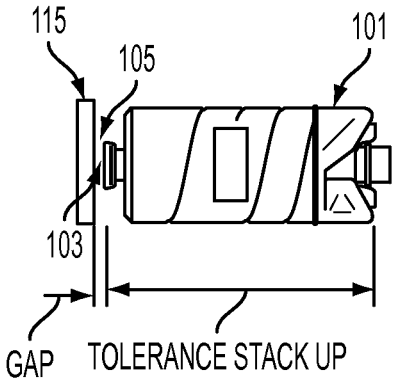
FIG. 1 RELATED ART
FIG. 1 shows a related art CRUM-enabled cartridge system.

Exemplary embodiments are intended to cover all alternatives, modifications, and equivalents as may be included within the spirit and scope of the apparatus and systems as described herein.

Reference is made to the drawings to accommodate understanding of CRUM apparatus for monitoring CRUM-enabled cartridge systems. In the drawings, like reference numerals are used throughout to designate similar or identical elements. The drawings depict various embodiments of illustrative systems for monitoring customer replaceable units such as cartridges for containing and supplying marking material such as ink or toner.

For example, a toner cartridge may be configured to include a CRUM device for acquiring system data such as toner level data. The CRUM device may be configured to communicate system data to a CRUM reader when the cartridge is engaged with a xerographic printing system with which the toner cartridge is configured to operate.

FIG. 1 shows a related art CRUM-enabled cartridge system wherein a cartridge 101 having a cap or fill plug 103 includes a CRUM device 105 attached thereto. The CRUM device 105 is positioned so that the device 105 can communicate with a CRUM reader 115 when the cartridge 105 is engaged with a system as shown. FIG. 1 shows that a tolerance stack of variance may result in a gap variance of the reader gap defined by the cap 103 and the reader 115. If the reader gap is too large, the CRUM device may not be reliably read, requiring in-person and/or remote servicing of the system. As such, a desire for ensuring a consistent reader gap among different cartridges despite tolerance stack up variance was determined.

Figure 2:
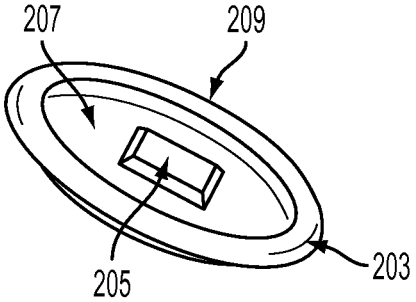
FIG. 2 RELATED ART
FIG. 2 shows a related art CRUM-enabled cartridge system having a CRUM device disposed on a cap of the cartridge.

Related art cartridges such as toner cartridges use a flexible fill plug to plug the toner fill opening in the cartridge body. A related art cap or plug 203 is shown in FIG. 2. In particular, a cap 203 is used to fill an opening in a cartridge after the cartridge is filled with toner. The cap 203 includes a CRUM device 205 disposed an inner surface 207 that is substantially planar, and extends beneath a top portion of a peripheral surface 209. The cap 203 includes a raised peripheral edge surface 209 that covers an edge of a fill opening when engaged with a cartridge. The surface 207 does not extend above the surface 209.

A cap in accordance with embodiments may be a modified cap or plug as shown in FIGS. 1-2. In particular, the cap or plug in accordance with embodiments may include an configuration that accommodates varying tolerance stack up and ensure that the CRUM device is retained on surface of the cap whereby the CRUM device is centrally axially disposed for reading by a CRUM reader. A mounting surface of the cap is configured for receiving and retaining the CRUM device. The mounting surface is surrounded by a peripheral surface. When the cap is in a disengaged position, the mounting surface may be disposed above the top-most portion of the peripheral surface. The mounting surface and the peripheral surface may be formed to enable the mounting surface to depressible from a disengaged, resting position to a position at which the mounting surface approaches and or passes a plane of the peripheral surface while storing an increasing amount of potential force. The spring force causes the mounting surface to readily return toward a resting, disengaged position as a counteracting force against the surface is decreased to zero.

The mounting surface may be formed to include a recess for receiving a CRUM device, and latches, snaps, or other fastening means for securing the CRUM device to the mounting surface. Areas of the cap or plug that contact the CRUM reader may be formed to include a wear resistant or lubricating material such as TEFLON, to minimize wear caused by, e.g., rotational travel. Alternatively, a wear-resistant surface may be disposed on the CRUM device surface. Cartridge caps in accordance with embodiments enable reliable CRUM device reading from an axial position.

Figure 3:
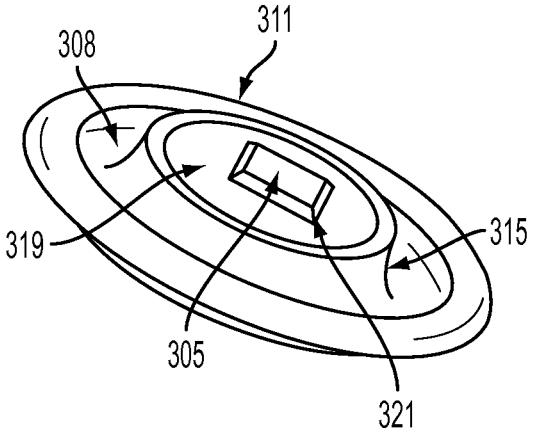
FIG. 3 shows a related art CRUM-enabled cartridge system having a CRUM device disposed on a cap of the cartridge in accordance with embodiments.

FIG. 3 shows a cap or plug for a toner cartridge in accordance with an exemplary embodiment. In particular, FIG. 3 shows a CRUM-enabled cap 305 having a mounting surface 308 surrounded by a peripheral surface 311. The cap 305 of FIG. 3 is formed so that the mounting surface 308 is contiguous with the peripheral surface 311. The cap 305 is formed of a flexible material whereby the mounting surface walls 315 are depressible under load. The walls 315 spring back toward a resting position as shown in FIG. 3 when a load is released.

A recess 319 is configured to receive the CRUM device. The CRUM device is preferably disposed in a central axial position with respect to a rotational axis of the cap and cartridge to which the cap is attached when the cartridge is engaged to a system having a CRUM reader. In a resting position wherein the mounting surface 308 is not under additional load, the mounting surface may be disposed at a position above a peripheral surface 311, or a plane on which an uppermost portion of the peripheral surface 311 lies. As the cartridge is urged against a CRUM reader, the mounting surface 308 may be depressed, urging the mounting surface 308 toward the cartridge. Accordingly, reader gaps may be prevented, even with varying tolerance stack up.

The surface 308 extending above the surface 311 forms a spring wherein a flexible wall 315 may compress when a vertical load is applied to surface 308 as would occur, for example, when a door containing a CRUM reader is closed on a cartridge engaged with a printing system. A wear strip formed of silicon, or TEFLON, for example, may be placed in the surface 308 prevent or minimize wear. A recess 319 having a depth that 0.2 mm deeper than a thickness of the CRUM device ensures that the CRUM is placed in annular system. Detents 321 formed in the surface around edges of the recess may be configured for securing the CRUM device in the recess 319.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A CRUM device positioning apparatus for use in a printing system for aligning a CRUM device for reading by a CRUM reader, comprising:

a cap configured for covering or plugging a container, the cap comprising:

a peripheral surface; and a mounting surface, the mounting surface being surrounded by the peripheral surface, and when in a resting position, extending above the peripheral surface and away from a cavity defined by the container being covered when the cap is engaged to the container;

a wear strip formed of silicon is placed in the mounting surface to minimize wear, wherein the CRUM reader is disposed on a cartridge cover door on the printing system.

2. The apparatus of claim 1, comprising:

flexible walls, the flexible walls connecting the mounting surface and the peripheral surface, the flexible walls being compressible under load whereby the mounting surface is depressible from the resting position to a load-bearing position wherein a spring force urges the mounting surface towards the resting position.

3. The apparatus of claim 2, comprising:

a recess disposed in the mounting surface, the recess being formed to cause a CRUM device to be centrally aligned for central axial alignment along a rotational axis of the container when the cap is engaged to the container.

4. The apparatus of claim 3, comprising:

a plurality of detents formed in the mounting surface forming securing the CRUM device in the recess.

5. The apparatus of claim 1, comprising:

a CRUM device disposed on the mounting surface.

6. The apparatus of claim 4, comprising:

a CRUM device secured by the detents in the recess.

7. The apparatus of claim 3, comprising:

a CRUM device disposed in the recess.

8. The apparatus of claim 1, wherein the mounting surface contacts the CRUM reader when a container to which the cap is connected is in the engaged position.

9. The apparatus of claim 7, the recess having a depth that is 0.2 mm deeper than a thickness of the CRUM device.

10. The apparatus of claim 1, the container being a toner cartridge.

11. The apparatus of claim 7, the recess being configured to cause the CRUM device to be placed at a position on an axial center line or central rotational axis of the cap and the container whereby the CRUM device is configured for alignment with a CRUM reader.

* * * * *